United States Patent [19]

Torrance

[11] 4,080,745

[45] Mar. 28, 1978

[54] FOOTWEAR

[76] Inventor: Joseph Torrance, 51 Rylees Pl., Penilee, Glasgow, Scotland

[21] Appl. No.: 688,907

[22] Filed: May 19, 1976

[30] Foreign Application Priority Data

May 21, 1975 United Kingdom ..... 21720/75

[51] Int. Cl.[2] ..... A43B 11/00; A43B 7/06; A43B 5/00

[52] U.S. Cl. ..... 36/50; 36/3 A; 36/127

[58] Field of Search ..... 36/3 R, 3 A, 11.5, 50, 36/127, 83, 114, 59 R, 126, 128, 129

[56] References Cited

U.S. PATENT DOCUMENTS

| | | | |
|---|---|---|---|
| D. 73,450 | 9/1927 | Tauber | 36/3 A X |
| D. 113,057 | 1/1939 | Calderazzo | 36/3 A |
| 2,311,959 | 2/1943 | Nurk | 36/3 A |
| 2,784,503 | 3/1957 | Anderson | 36/127 |
| 3,327,410 | 6/1967 | Park et al. | 36/50 |
| 3,703,775 | 11/1972 | Gatti | 36/128 |

FOREIGN PATENT DOCUMENTS

| | | | |
|---|---|---|---|
| 571,481 | 2/1933 | Germany | 36/50 |

*Primary Examiner*—Patrick D. Lawson
*Attorney, Agent, or Firm*—Mason, Fenwick & Lawrence

[57] ABSTRACT

A common style of sports shoe which is generally recognized as providing maximum support for the foot has an upper with a foot-receiving opening which includes a slot or elongated gap or notch extending forwards and downwards over the instep of the foot, said shoe also having on the upper a tongue which lies under the gap or notch to close same and a lace or cord threaded through perforations at opposite sides of the gap to fasten the shoe to the foot. The comfort of such a shoe is greatly improved by omitting the tongue and lace and thereby providing foot ventilation, and fastening the shoe to the foot by a strap-and-buckle fastener anchored at its ends to opposite sides of the sole of the shoe and engageable over the instep of the foot. With the strains created by the weight of the sole transferred from the upper to the fastener, the upper may be apertured or of a light-weight air-pervious material to provide additional ventilation. In this way maximum comfort can be achieved without reducing essential foot support.

22 Claims, 6 Drawing Figures

6
1
2
25
26
26
VI
VI
19
IV
III
20
27
19
32
28
16
3
B
V
29
30
31
V
21
22
23
24
C
5
7
4
A

FOOTWEAR

FIELD OF THE INVENTION

This invention relates to footwear, and especially footwear for sports use.

PRIOR ART

An existing type of sports footwear comprises a sole structure, a welted upper extending continuously around and attached to the sole structure and so shaped as to form a foot-receiving opening which includes a longitudinal slot extending forwardly and downwardly over the instep of the foot, a tongue on the upper extending under the slot to close same, and fastening means in the form of a lace or cord threaded through perforations in the upper at opposite sides of the slot.

The aforesaid type of footwear is usually heavy and hot in wear, but has important advantages for golfers or other sportsmen, as the upper gives very good support to the foot. Hitherto it has been considered unavoidable that such footwear should lack the high degree of comfort of leisure or casual footwear.

SUMMARY OF THE INVENTION

I have found that it is possible to provide footwear which combines a high degree of comfort with the practical advantages of the aforesaid prior art footwear. Thus, I provide footwear comprising a sole structure, an upper extending continuously around and connected to the sole structure and shaped to form a foot-receiving opening which with the foot inserted leaves a portion of the instep of the foot exposed to enable ventilation of the foot, and fastening means attached to opposite sides of the sole structure and extendible over the instep of the foot to secure the sole structure and the upper to the foot.

Preferably the upper has a continuous lower periphery connected to the periphery of the sole structure whereby the foot-supporting capability of the upper is in the order of that of a welted shoe.

Preferably also the upper is shaped to form a foot-receiving opening which with the foot inserted forms a longitudinal ventilating slot extending forwardly and downwardly over the instep of the foot. As the upper is no longer held constricted around the foot by a lace, it can accommodate itself to the movement of the foot while simultaneously supporting the foot.

In sum, by dispensing with the usual tongue and lace and connecting the fastening means directly to the sole structure, the upper is free to accommodate to the foot and presents a foot-ventilating opening at the instep so that the comfort of the footwear is considerably enhanced without adversely affecting its essential foot-supporting capability.

Preferably also foot-ventilating through openings are provided in the material of the upper. Since the weight of the sole structure is not now carried by the upper, it is possible to weaken the upper with ventilating openings at selected positions and thereby improve comfort without reducing essential foot support.

Preferably also the footwear is welted and the fastener is a strap-and-buckle fastener. With this arrangement highly efficient production of the footwear is possible as the strap portions of the strap-and-buckle fastener can be quickly and easily anchored to the sole structure by sandwiching the strap portions between the welt and the upper so that the same row of stitching which interconnects the welt, the upper and the insole also penetrates the strap portions to secure same.

PREFERRED EMBODIMENT

An embodiment of the invention will now be described by way of example with reference to the accompanying drawings in which.

Figure 1:
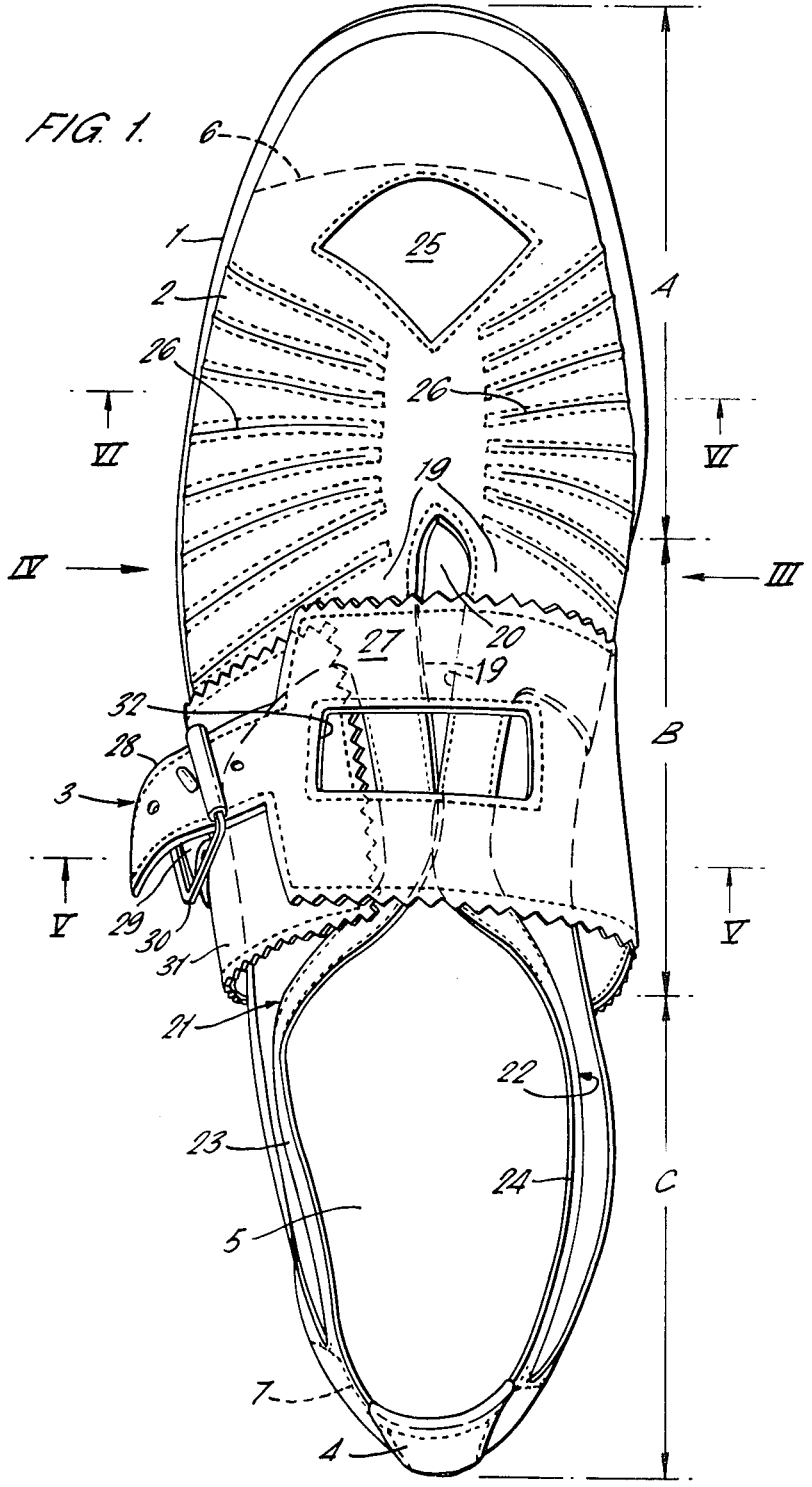
FIG. 1 is a top plan view of a welted golf shoe of leather.
Figure 2:
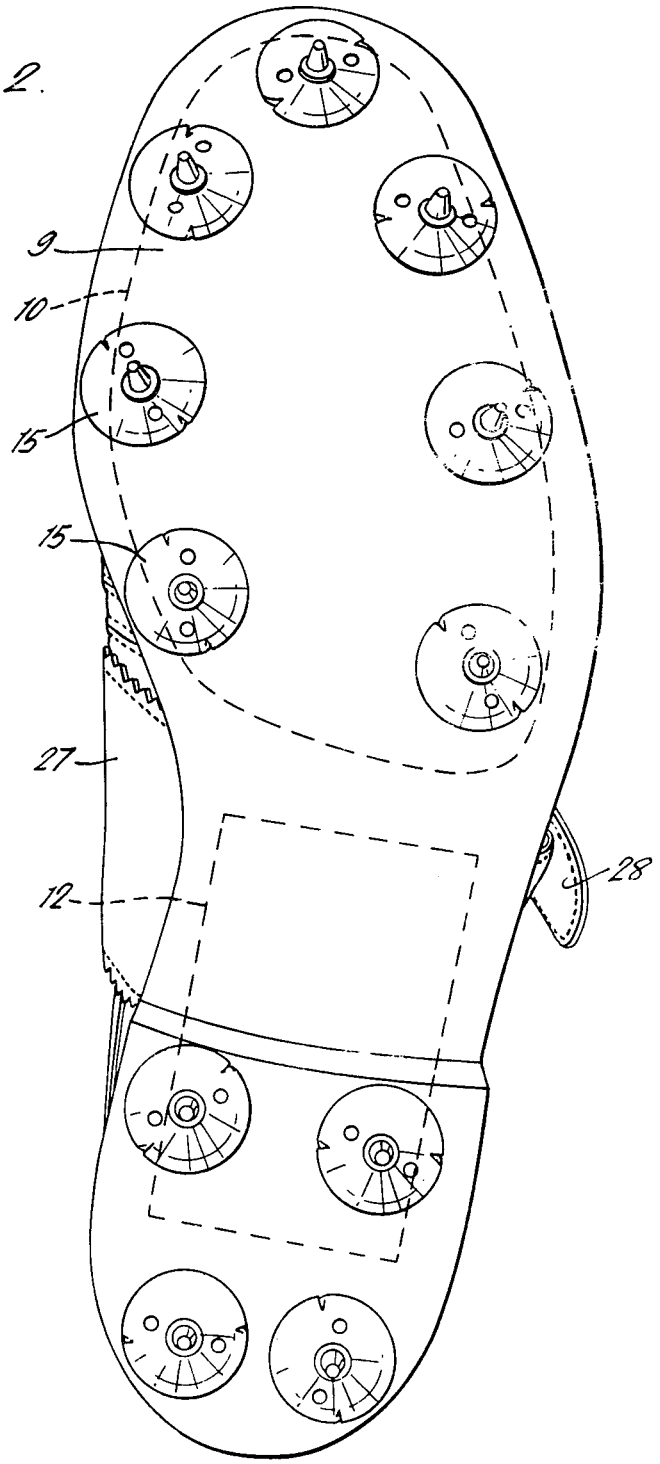
FIG. 2 is a bottom plan view of the shoe of FIG. 1.
Figure 3:
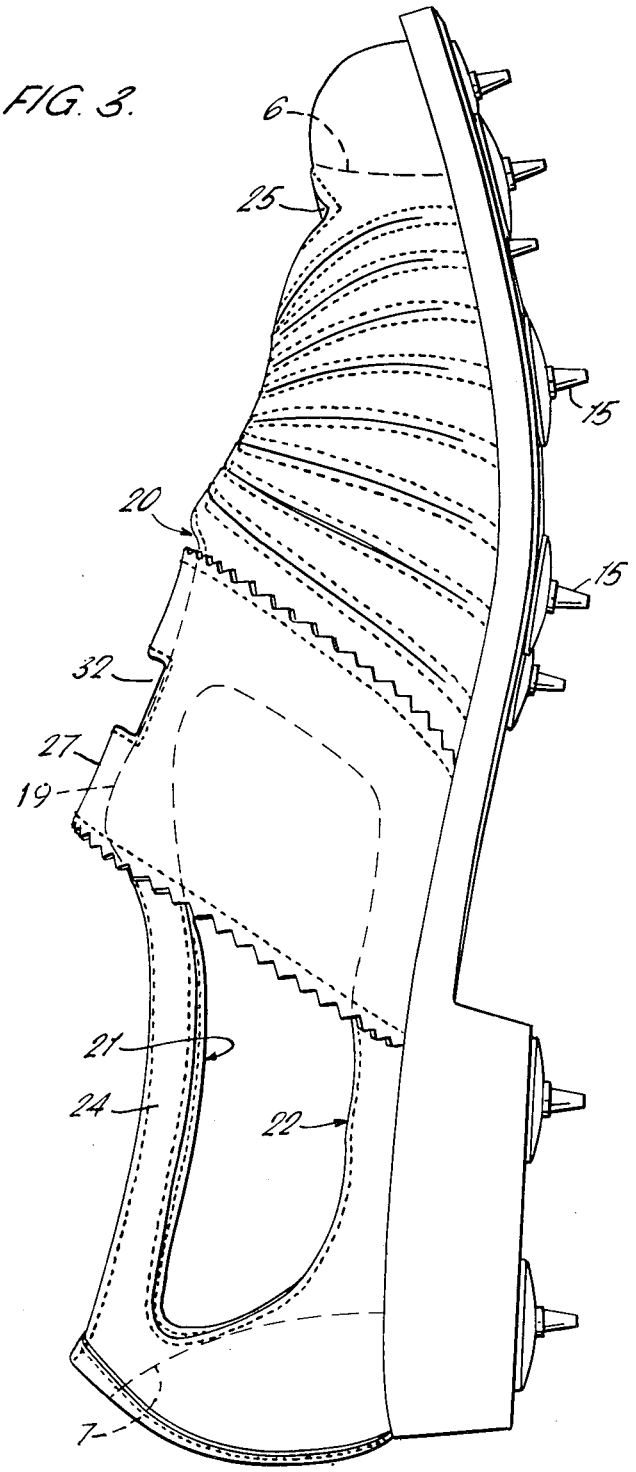
FIG. 3 is a side view in the direction of the arrow III in FIG. 1.
Figure 4:
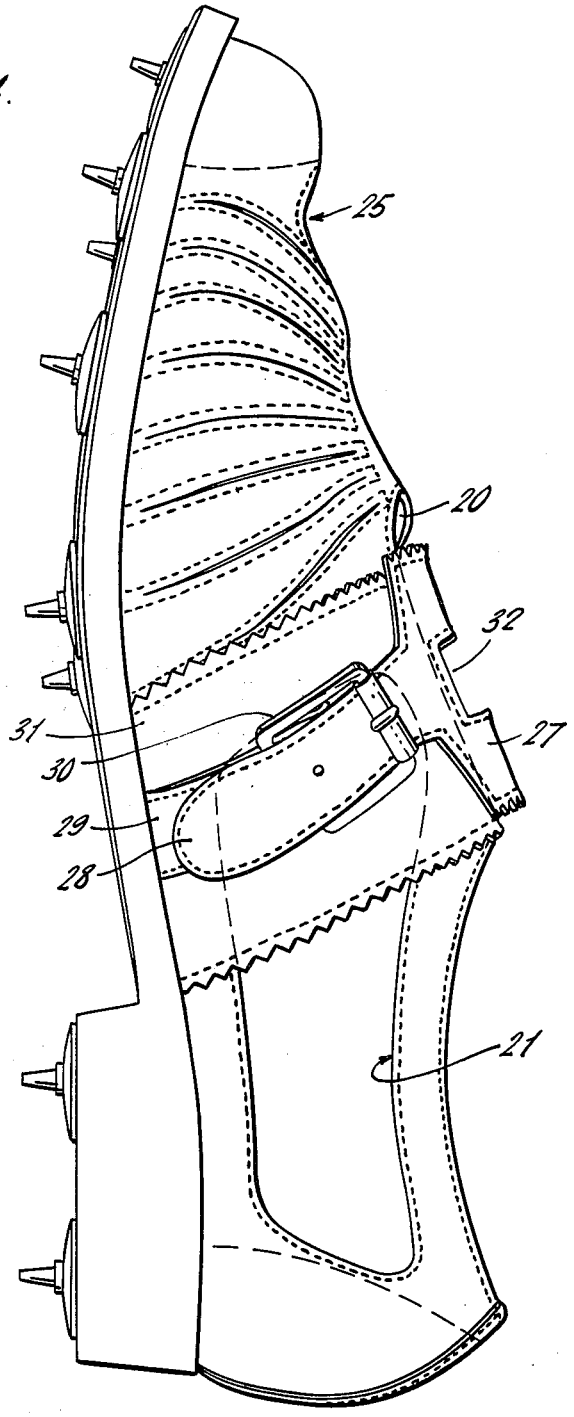
FIG. 4 is a side view in the direction of the arrow IV in FIG. 1.
Figure 5:
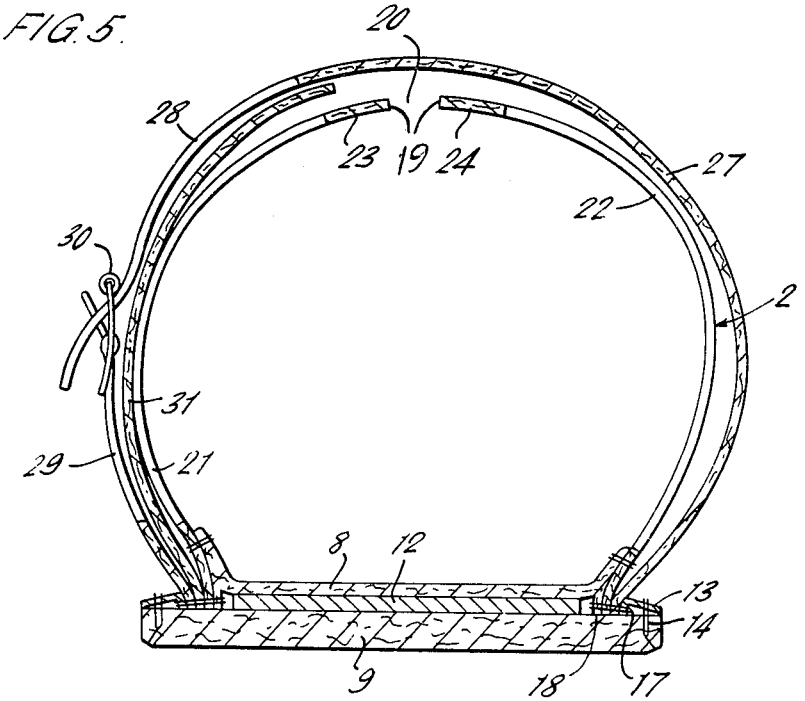
FIG. 5 is a cross-sectional view on the line V—V of FIG. 1.
Figure 6:
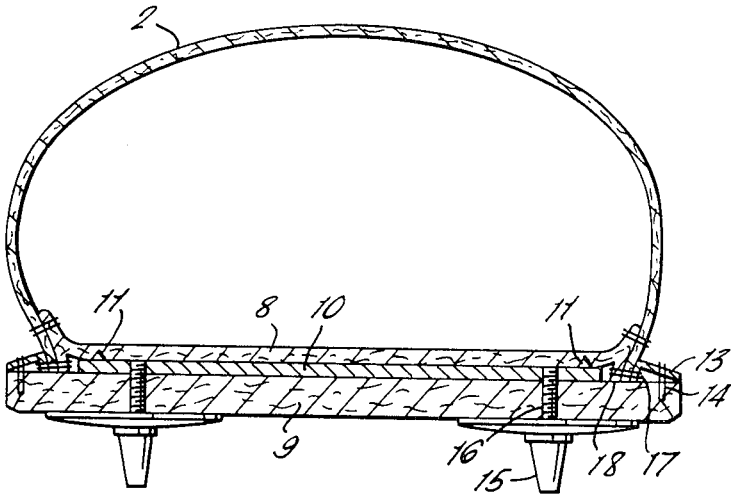
FIG. 6 is a cross-sectional view on the line VI—VI of FIG. 1.

Referring to the drawings:

A welted golf shoe of leather comprises a sole structure 1, an upper 2 connected to the sole structure, and a strap-and-buckle fastener 3 connected to the sole structure. The upper 2 is in the form of a continuous peripheral wall connected at its lower end to the sole structure 1 and composed of a front part A to extend over the front of the foot, a mid part B to extend over substantially the entire length of the instep and a rear part C to extend around the heel. The wall is formed of a single piece of material having upright edges thereof joined by a seam 4 at the heel, and the rear and mid parts C and B thereof form a top opening 5 enabling insertion of the foot. The top edge of the wall is continuous, defining the elongate, generally elliptical top opening 5, while the bottom has thereon an integral continuous extension connected throughout its entire length to the sole structure. The wall embodies toe and heel stiffeners 6 and 7. The sole structure consists of an insole 8, an outsole 9, a metal plate 10 between insole and outsole at the front of the structure and anchored on the insole by prongs 11, a stiffening plate 12 between insole and outsole at the rear of the structure, a welt 13 secured by stitching 14 to the outsole, and anti-slip devices including studs 15 on the outsole and screw-threaded stems 16 extending through the outsole and engaging in tapped openings in the plate 10. Horizontal stitching 17 penetrates the welt 13, the upper 2 and a peripheral ridge 18 on the insole 8 to secure the bottom of the upper to the sole structure.

The opposed side stretches of the peripheral edge of the top opening have wide-angled inverted-V profiles so that mid part B has a pair of laterally opposed top V portions or flaps 19 which define the front stretch of the top opening 5 and which, on being folded on to the instep of the foot, form between them a foot-ventilating slot or elongate notch 20 extending forwards and downwards along the instep, the usual tongue and lace being omitted.

The upper has formed therethrough a pair of laterally opposed foot-ventilating openings 21 and 22 which extend downwards to the insole 8 and longitudinally into the mid and rear parts B and C to provide a pair of laterally spaced top straps 23 and 24 engageable with the instep and the rear of the foot. A segmental opening 25 in the front part A of the upper substantially centrally thereof provides additional ventilation for the foot. Also the front part A of the upper has therein side-by-side series of transverse through-slits 26 which provide ventilation and also increase the flexibility of the part.

The zones of the upper containing the stiffeners 6 and 7 are imperforate to maintain the strength of the upper at these zones and thereby ensure optimal support for the foot despite the weakening of the upper caused by the ventilating openings.

The fastener 3 is in two laterally opposed parts, one consisting of a broad strap 27 with an integral apertured tongue 28 thereon and the other consisting of a strap 29 on which is a buckle 30 to receive the tongue 28, and a broad strap 31 for engagement by the strap 29 and for overlap by the strap 27 so that when the shoe is fastened the broad, overlapping straps 27 and 31 are interconnected to form a broad U-band tightened around the mid part B of the upper and thereby securing the flaps 19 and supporting substantially the entire instep portion of the foot. The broad straps 27 and 31 slope longitudinally forwards and upwards from the sole structure so that in the flap-securing position the strap tops slope widthwise substantially in conformity with the slope of the instep. A ventilating opening 32 in the strap 27 coincides with the slot 20 in the upper when the shoe is fastened, so that ventilation of the foot is assisted. Moreover, as shown the strap 27 leaves open a lower end portion of the slot 20 to further assist ventilation of the foot.

The lower ends of the straps are sandwiched between the welt 13 and the upper 2, and the stitching 17 penetrates the straps to anchor same between the welt and the upper.

It is found that the shoe in wear gives the firm foot-support required by golfers, and at the same time the degree of comfort is comparable to that experienced with a well-ventilated soft shoe or sandal. The foot does not move in the shoe under the pressures created during play, and walking is more pleasurable as there is a considerable reduction in the weight of the shoe and there is no overheating of the foot.

Modifications may be made. Thus, the upper may be of a lightweight air-pervious material instead of leather, in which event the ventilating openings in the material of the upper may be omitted.

I claim:

1. Footwear comprising a sole structure, an upper connected to the sole structure and including a rear portion and a pair of opposed intermediate portions together providing a top opening through which the foot is insertable, the intermediate portions of the upper including a pair of laterally opposed top parts foldable onto the instep portion of the foot, a fastener on the sole structure including a pair of flexible straps extending respectively from opposite sides of an intermediate portion of the sole structure and interconnectible to enclose the intermediate portions of the upper and thereby clamp the top parts of said intermediate portions to the instep portion of the foot, said top parts of the intermediate portions of the upper are foldable onto the instep portion of the foot to form a slot extending forwardly and downwardly over the instep portion of the foot, the straps are manipulable to a securing position in which they extend around the respective intermediate portions of the upper and one of the straps extends over the slot and overlaps the other strap, and means are provided for releasably interconnecting the straps in their securing position.

2. Footwear according to claim 1, wherein the strap extendible over the slot for connection to the other strap has therethrough an aperture for registry with the slot to permit ventilation of the instep portion of the foot.

3. Footwear according to claim 2, wherein the apertured strap in securing position leaves open a lower end portion of the slot to further assist ventilation of the foot.

4. Footwear according to claim 2, wherein foot-ventilating through openings are provided in the upper.

5. Footwear according to claim 4, wherein a pair of laterally opposed foot-ventilating through openings extend downwards to the sole structure and longitudinally into the intermediate and rear portions of the upper.

6. Footwear according to claim 5, wherein a foot-ventilating through opening is provided substantially centrally in a front part of the upper.

7. Footwear according to claim 6, wherein the front part of the upper has therein a pair of side-by-side series of transverse through-slits.

8. Footwear according to claim 4, wherein the sole structure has a set of anti-slip devices projecting therefrom.

9. Footwear comprising a sole structure, an upper connected to the sole structure and having at the top thereof a pair of side flaps foldable onto the sides of the instep portion of the inserted foot to form a slot between them, and a fastener on the sole structure including strap means connected to a mid portion of the sole structure and foldable around the exterior of the upper and over the slot to engage the flaps and clamp them to the inserted foot.

10. Footwear according to claim 9, wherein the upper has thereon a continuous lower integral extension connected throughout its entire length to the sole structure.

11. Footwear according to claim 9, wherein the fastener includes securing means associated with the strap means to enable the strap means to be tightened around the exterior of the upper and releasably held in tightened position.

12. Footwear according to claim 11, wherein the securing means consist of tongue-and-buckle means.

13. Footwear according to claim 11, wherein the top edge defining the top foot-receiving opening in the upper has side portions of inverted-V profile so that the upper includes at the sides thereof a pair of integral V-flaps forming the side flaps which are foldable apart to facilitate insertion of the foot and are foldable onto the instep portion of the inserted foot.

14. Footwear comprising a sole structure, an upper connected to the sole structure and having at its top a pair of side flaps foldable onto the instep portion of the inserted foot to form a slot sloping forwards and downwards along the top of the instep portion of the inserted foot, and a fastener on the sole structure including first and second straps connected respectively to opposite sides of the mid portion of the sole structure and releasable securing means for the straps, the first strap being foldable around the exterior of one side of the upper to terminate at or near the slot edge at said side, and the second strap being foldable around the exterior of the other side of the upper and across the slot to overlap the first strap.

15. Footwear according to claim 14 wherein the securing means include a buckle associated with the first strap and a tongue on the second strap cooperable with the buckle to enable the straps to be tightened around the upper and releasably secured in tightened position.

16. Footwear according to claim 14, wherein the straps extend longitudinally forwards and upwards from the sole structure so that in tightened position they slope widthwise at the top of the instep portion of the foot in conformity with the slope of the top of the instep portion.

17. Footwear according to claim 16, wherein the width of the straps is such that together in tightened position they embrace and support substantially the entire instep portion of the foot.

18. Footwear according to claim 14, wherein the second strap has therethrough an aperture for registry with the slot to permit ventilation of the instep of the foot.

19. Footwear according to claim 18, wherein the apertured strap in securing position leaves open a lower end portion of the slot to further assist ventilation of the foot.

20. Footwear according to claim 14, wherein foot-ventilating through openings are provided in the upper.

21. Footwear according to claim 20, wherein the sole structure includes a set of ground-engagable anti-slip devices.

22. Footwear comprising a sole structure, an upper connected to the sole structure and having at the top thereof a pair of side flaps foldable onto the sides of the instep portion of the inserted foot to form a longitudinal slot sloping forwards and downwards along the top of the instep portion, and a fastener on the sole structure including strap means connected to a mid portion of the sole structure so as to be free of the upper, said strap means being foldable around the exterior of the upper and over the slot from side to side thereof to a tightened position clamping the flaps to the inserted foot.

* * * * *